United States Patent [19]

Paulus, Jr. et al.

[11] Patent Number: 4,891,843

[45] Date of Patent: Jan. 2, 1990

[54] ELECTRET MICROPHONE

[75] Inventors: Frank S. Paulus, Jr., Chesterfield Twp., Burlington Cty., N.J.; Isaac Tuah-Poku, Falls Twp., Lower Bucks Cty., Pa.

[73] Assignee: AT&T Technologies, Inc., Berkeley Heights, N.J.

[21] Appl. No.: 469,489

[22] Filed: Feb. 24, 1983

[51] Int. Cl.[4] ..... H04R 19/00; H04R 19/01

[52] U.S. Cl. ..... 381/191; 381/174

[58] Field of Search ..... 179/111 E, 111 R; 367/170; 310/309; 307/400

[56] References Cited

U.S. PATENT DOCUMENTS

| | | | |
|---|---|---|---|
| 3,958,662 | 5/1976 | Brzezinski et al. | 381/191 |
| 4,035,903 | 7/1977 | Taggart | 29/458 |
| 4,052,667 | 10/1977 | Schwartz | 324/65 P |
| 4,141,366 | 2/1979 | Cross, Jr. et al. | 128/640 |
| 4,188,513 | 2/1980 | Morrell et al. | 381/174 |
| 4,236,051 | 11/1980 | Nakagawa et al. | 381/191 |
| 4,248,808 | 2/1981 | West | 307/400 |
| 4,249,043 | 2/1981 | Morgan et al. | 381/191 |
| 4,379,211 | 4/1983 | Joscelyn et al. | 179/110 A |
| 4,436,648 | 3/1984 | Khanna et al. | 381/173 |
| 4,447,678 | 5/1984 | Fidi | 179/111 E |
| 4,475,014 | 10/1984 | King | 179/110 A |
| 4,492,825 | 1/1985 | Brzezinski et al. | 179/111 R |

OTHER PUBLICATIONS

"The EL2 Electret Transmitter: Analytical Modeling, Optimization and Design", *The Bell System Technical Journal, vol. 58, No. 7, Sep. 1979 pp. 1557–1578.*

"The EL2 Electret Transmitter: Technology Development", *The Bell System Technical Journal*, vol. 59, No. 5, May/Jun. 1980 pp. 745–762.

*Primary Examiner*—Jin F. Ng

*Assistant Examiner*—Danita R. Byrd

*Attorney, Agent, or Firm*—Maurice M. de Picciotto; Robert B. Levy

[57] ABSTRACT

An electret microphone (10) comprises an electret diaphragm (11) having a thin metallic layer (13) deposited on one of its major surfaces. A ring-shaped metal washer (20) bonded to the metallic layer (13) of the diaphragm (11) by means of a lightly metal-filled adhesive (21).

1 Claim, 3 Drawing Sheets

ELECTRET MICROPHONE

FIELD OF THE INVENTION

The present invention relates generally to transducers for telephone sets, and more particularly, to an electret transducer assembly and a method for making such an electret transducer.

BACKGROUND OF THE INVENTION

Polymer film electret microphones have generated an increased interest in telephony due to their relatively high output electrical signals, their low sensitivity to external mechanical vibrations, and their immunity to electromagnetic signal interferences. An article by J. C. Baumhauer, Jr. et al. entitled "The EL2 Electret Transmitter: Analytical Modeling, Optimization, and Design" published in *The Bell System Technical Journal*, Vol. 58, No. 7, Sept. 1979, pages 1557–1578, discusses the basic operation of an electret transducer in general, and describes in particular an electret microphone transmitter used primarily in the Type 4A Speakerphone hands-free-answer system manufactured by Western Electric Co., Inc.

Shown in FIG. 5 of the above Baumhauer article, and further described in an article by S. P. Khanna et al. entitled "The EL2 Electret Transmitter: Technology Development" in *The Bell System Technical Journal*, Vol. 59, No. 5, May-June 1980, pages 745–762, the electret transmitter subassembly comprises an electret diaphragm having a gold metallization on one side thereof. A spring clip in combination with a clamping plate arrangement provides the mechanical support for the diaphragm. Moreover, the spring clip/clamping plate structure is necessary to maintain a required tension in the diaphragm. Various polymeric fluorocarbon films suitable for making electrets (such as polytetrafluoroethylene (PTFE, FEP, ETFE, CTFE) exhibit mechanical anisotropy resulting from their respective processes of manufacture. For example, when a TEFLON® FEP film is heated above approximately 100° C. and cooled to room temperature, such film exhibits an elongation along its longitudinal direction and a shrinking along its transversal direction. An inherent problem with such a film is that its anisotropy at elevated temperature causes the electret film to wrinkle. Unwrinkling of the film would require heating it and applying some tension in its transversal direction. The foregoing would result in dislocations of the thin metallization layer due to the difference between its thermal expansion coefficient and that of the film.

An alternative to rectangularly shaped electret transducers is described in U. S. Pat. No. 4,249,043 to A. J. Morgan et al. wherein a circular electret foil is heated and bonded to a retaining circular ring using a cyanoacrylate adhesive. In light of the embodiments described in FIGS. 2 and 4 of this Morgan et al. patent, the thermal radial tensioning of the electret foil is not sufficient since the backplate has a protruding flange for further stretching the electret foil. Furthermore, cyanoacrylate adhesive joints between the electret foil and the ring were found unreliable when exposed to adverse environmental aging conditions of temperature and humidity (such as 85% relative humidity at 85° C.). Moreover, cyanoacrylates have relatively fast curing times resulting in various storage and handling constraints in a manufacturing environment.

Therefore, there exists a need for an electret transducer/microphone exhibiting high reliability and designed to meet high volume production requirements.

SUMMARY OF THE INVENTION

The foregoing problems are solved in accordance with an embodiment of the invention wherein an electret transducer comprises a uniformly radially tensioned electret diaphragm having a thin metal layer deposited on one of its major surfaces; and a ring-shaped metal washer bonded to the metallized layer of the electret diaphragm by means of a lightly metal-filled adhesive.

In one illustrative embodiment of the invention, the thin metallized layer is selected from the group comprising chromium, gold, aluminum and silver. In accordance with a preferred embodiment of the invention, the metal washer is made of a nickel-plated brass material and the lightly metal-filled adhesive is an epoxy comprising approximately 4% nickel.

In accordance with one embodiment of the invention, a method for forming an electrically conductive bond between a thin metallized film of insulating material and a metal ring comprises the steps of depositing on an annular surface of the metal ring a predetermined quantity of a lightly metal-filled adhesive; contacting the metallized portion of the film with the adhesive-coated annular surface of the ring; and applying a clamping force between the film and the metal ring while curing the adhesive.

In accordance with a further embodiment of the invention, a method for forming a plurality of electret transducers comprises the steps of forming a matrix array of photodefined ring-shaped metal washers on a carrier; screen printing a lightly metal-filled adhesive on the washers of the array; contacting the metallized surface of a sheet of electret material with the adhesive-coated washers of the matrix array; and applying a clamping force between the carrier and the electret sheet while curing the adhesive.

DETAILED DESCRIPTION

Figure 1:
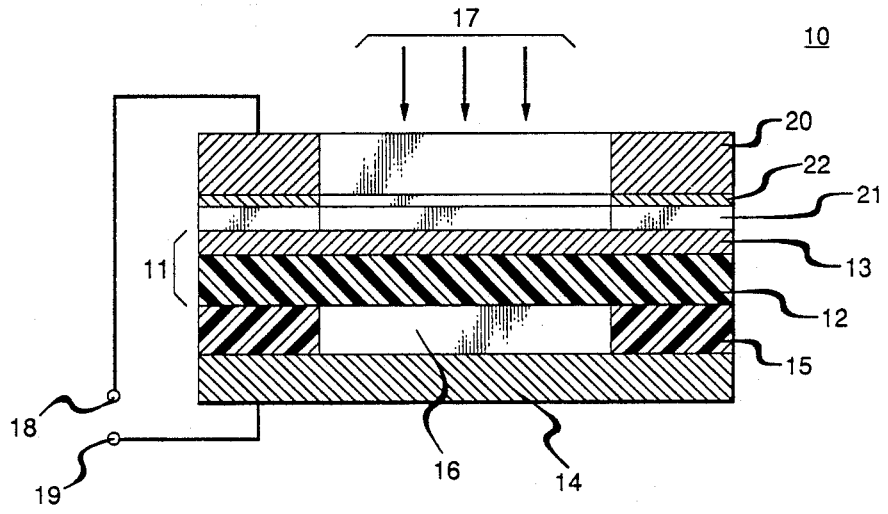
FIG. 1 illustrates an enlarged cross-sectional view of an embodiment of the invention.

In FIG. 1, reference numeral 10 indicates generally an electret microphone having a substantially cylindrical form. The microphone 10 comprises an electret diaphragm 11 including a polymer film 12 with a thin metal layer 13 on one of its major surfaces. As mentioned in the above articles of Baumhauer et al. and Khanna et al., the electret diaphragm 11 is spaced away from a stationary back electrode 14. As shown in the drawing, an air gap 16 is formed as the result of a spacer 15 positioned between the non-metallized surface of the polymer film 12 and the back electrode 14. The charge on the electret film 12 creates an electric field across the air gap 16. Sound waves (schematically illustrated by arrows 17) impinging on the diaphragm 11 modulate the electric field and generate a voltage drop across the metal layer 13 and the back electrode 14. The output signal of the microphone 10 is present at output terminals 18 and 19 which are respectively electrically coupled to the metal layer 13 and the back electrode 14.

The electret diaphragm 11, having one surface metallized, is to remain tensioned with its metallized surface facing away from the back electrode 14. A predetermined tension on the electret diaphragm 11 unwrinkles the metallized polymer film 12 to render it sensitive to the sound waves 17. In order to subject the diaphragm 11 to a desired uniform radial tension, and at the same time achieve the electrical connection between the output terminal 18 of the microphone 10 and the metallized electret film, a metal ring 20 is attached to the metal layer 13 of the electret diaphragm 11 and is electrically coupled to the output terminal 18. In accordance with an embodiment of the invention, the metal ring 20 is bonded to the metallized electret diaphragm 11 by means of an adhesive layer 21. Such a bond must be ohmic and remain stable during the life expectancy of the microphone because the reliability of the electret microphone 10 will depend on the quality of the adhesive joint between the metal ring 20 and the metallized diaphragm 11.

The material of the adhesive layer 21 between the metal ring 20 and the diaphragm 11 must meet several requirements. First, since the natural frequency of the diaphragm 11 would be affected by foreign material in the diaphragm, the adhesive selected must not bleed into the central area of the film 12. Also, due to differences in coefficient of expansion and rigidity of the diaphragm material and the metal ring, a semi-rigid cure adhesive which would share the rigidness of the metal and the flexible nature of the electret film would be preferred. Furthermore, in order to avoid any creep within the joint, a very thin bond line is preferable.

In accordance with an embodiment of the invention, conductivity between the metal ring 20 and the metal layer 13 of the electret diaphragm 11 is achieved by using a lightly metal-filled adhesive which is not conductive in bulk. Well known conductive adhesives usually contain over 70 weight percent of metal filler. However, applicants have found that, for the electret diaphragm application, the high conductivity of the high metal content filled adhesives is not necessary. In fact, an increase in metal content often results in a reduction of the peel strength of the joint between the ring 20 and the diaphragm 11. When using a lightly metal-filled adhesive in a very thin bond layer, the metal particles included in the adhesive act as projections for through conductivity between the ring 20 and the metallized diaphragm 11. In a preferred embodiment of the invention, the metal ring 20 is made of brass having a coating 22 of nickel. The lightly metal-filled adhesive layer 21 is preferably an epoxy comprising a low percentage of a metal selected from the group including nickel, silver and copper.

Reliability of the electret microphone 10 is a function of the ohmic resistance of the joint and of the mechanical strength of the joint between the ring 20 and the metallized diaphragm 11. The joint resistance is measured from the edge of the ring 20 to the center of the metallization 13 on the polymer film 12. The measurement is a combination of the resistance of the bond and the resistance of the sheet of metallization between the center thereof and the ring. Several combinations of metallization were tested along with two low temperature curable metal-filled adhesives. Table 1 hereafter shows the relative effect of high temperature (85° C.) and humidity (85%) on the joint resistance of the electret diaphragm.

TABLE

| ADHESIVE | Metallization 13 | JOINT RESISTANCE (Ω) AS BONDED | 468 HRS. | 722 HRS |
|---|---|---|---|---|
| 4% Ni filled | Cr | 61.1 | 86.9 | 102 |
| | Ag | 0.76 | 31.9 | 125 |
| | Al | 1.14 | 17.3 | 19.1 |
| Conductive Ag filled | Cr | 120 | $\sim 10^3$ | $>10^3$ |
| | Ag | .34 | $\sim 10^3$ | $>10^3$ |
| | Al | 1.34 | $\sim 10^3$ | $>10^3$ |

Various compositions of metal-filled adhesive joints were tested to determine the effect of high humidity and temperature on the joint strength of the diaphragms. The mechanical integrity of the joint was measured while pushing the bonded film in a direction perpendicular to its major surfaces and away from the bond interface between the metal ring 20 and the diaphragm 11. The mechanical strength of the ring/diaphragm assembly is defined as the first maximum load prior to failure of the diaphragm. Table 2 hereafter shows the effect of high temperature (85° C.) and humidity (85%) on the joint strength.

TABLE 2

| ADHESIVE | METALLIZATION 13 | JOINT STRENGTH (kg) AS BONDED | 468 HRS. | 722 HRS. |
|---|---|---|---|---|
| 4% Ni filled | Cr | .94 ± .06 | .65 ± .06 | .67 ± .06 |
| | Ag | .78 ± .06 | .75 ± .05 | .57 ± .16 |
| | Al | .71 ± .07 | .66 ± .05 | .49 ± .15 |
| Conductive Ag filled | Cr | .48 ± .06 | .40 ± .09 | — |
| | Al | .48 ± .06 | .56 ± .04 | — |

As shown in the above Table 1, a chromium metallization 13 on the electret film 12 results in an increase in joint resistance of about 1.7 times after 722 hours. While the joint resistance is much lower with an aluminum and a silver metallization, the respective resultant joint resistance changes after 722 hours are about 17 times and 160 times. Furthermore, after 468 hours at 85° C. and 85% relative humidity, the aluminum and the silver metallizations respectively exhibited circumferential corrosion radiating from the joint area and cracks in several regions of the metallization. Table 2 shows that the bond strength for chromium reduces to about 70% of the original value after 468 hours of exposure and remains steady. However, even though the reduction in strength is similar for both an aluminum metallization and a silver one, the corrosion and the cracking mentioned above make the chromium a preferred metallization material.

Figure 2:
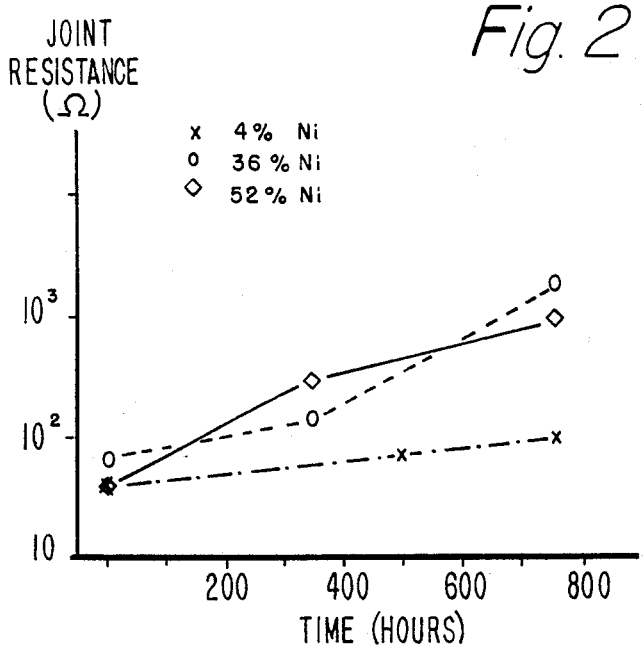
FIG. 2 illustrates the time variation of the adhesive joint resistance with various metal-filler compositions.

Various commercially available epoxy adhesives filled with various percentages of silver, copper or nickel were considered. A semi-flexible epoxy of the ABLEBOND 293 series, manufactured by The Ablestik Laboratories, was studied with various metal compositions to determine the stability and strength of a resultant lightly metal-filled adhesive joint in accordance with an embodiment of the invention. The diaphragm material selected was a 1 mil thick FEP TEFLON® polymer film with about 1000 Å chromium metallization on one side. As shown in FIG. 2, the 4% nickel samples remain fairly stable as compared with the 36% and 52% samples. Even though after 800 hours the joint resistance in most cases is still less than $10^4\Omega$, which would still be useful for an electret microphone, the 4% nickel samples show the most stability.

The electrical instability of the heavily metal-filled epoxies may be partly explained by the fact that the metal particles set up stress points which induce cracking in the cured adhesive. Such cracks may propagate and cause discontinuities at the bond interface. In fact, samples with higher metal percentages showed some degree of cohesive failure in the adhesive as contrasted with the clean peel of chromium for the 4% nickel-filled material.

Figure 3:
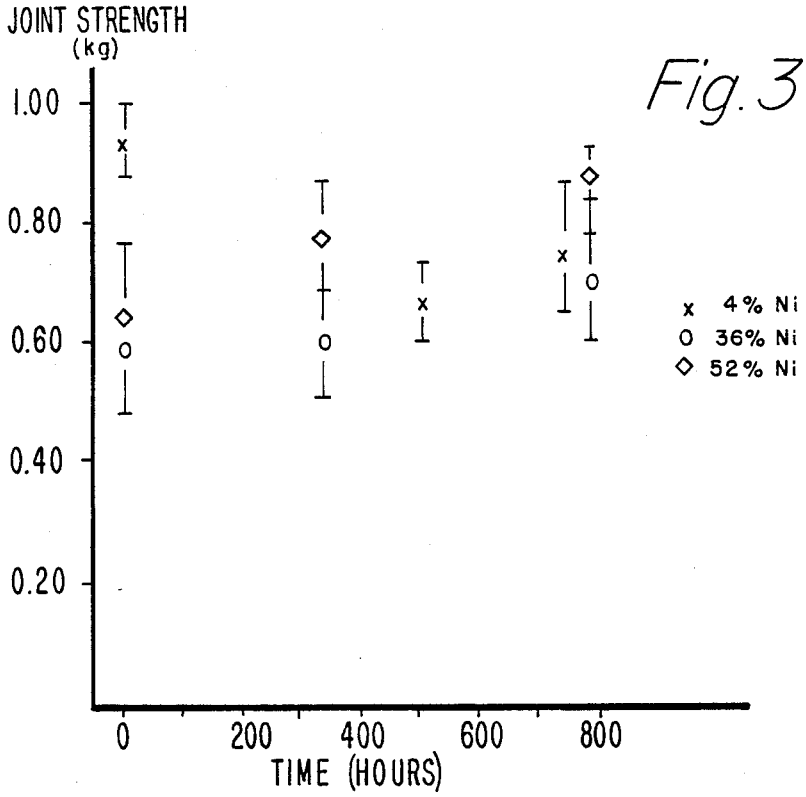
FIG. 3 illustrates the time variation of the adhesive joint strength, with various metal-filler compositions.

Similarly, after exposure for several hours at 85% relative humidity and 85° C., diaphragm samples were tested for relative joint strength. As shown in FIG. 3, exposure to these adverse conditions does not significantly affect the adhesive joint strength for samples with 36% and 52% nickel. However, the failure is a mixture of cohesive (in adhesive itself) and adhesive failure at the chromium-polymer film interface. In accordance with a preferred embodiment of the invention, a 4% nickel-filled epoxy exhibits an optimum combination of electrical and mechanical properties, as well as, a good stability and predictability under predetermined aging conditions.

The electret microphone 10 in accordance with an embodiment of the invention does not require any mechanical spring or clamping arrangement to maintain a desired uniform radial tension therein. As mentioned above, the adhesive bonding concept involves using a controlled thin layer 21 of a lightly metal-filled adhesive between the metal ring 20 and the metal layer 13. The adhesive layer 21 may be deposited either on the annulus of the metal ring 20 or onto the metallized diaphragm 11. Depositing the lightly metal-filled adhesive directly onto the metal ring 20 is a preferred way for achieving batch processing of a plurality of electret microphones. In other words, the illustrative embodiment of the invention as shown in FIG. 1 is geared towards high volume production at relatively low cost.

One method for fabricating electret transducers in accordance with the present invention will be described in connection with a technique for batch processing of an array of small composite structures each comprising an electret diaphragm adhesively bonded to a nickel-plated metal ring. However, adhesively bonding a single electret diaphragm to a single metal ring using the technique described hereafter is well within the spirit and scope of the present invention.

An array of ring-shaped washers is formed in a sheet of nickel-plated brass of about 15 mil in thickness. Preferably the ring-shaped washers are formed using a photoetching process. In such a process, a photo tool with two precisely aligned glass masks is used to photoexpose both sides of the sheet of nickel-plated brass and an initial etch cycle of 5 minutes is used to start the ring shaped washers. The partly etched sheet is then removed and dried. A pressure sensitive film carrier is laminated onto one side of the brass sheet. The laminate is then returned to the etcher to etch through the brass thereby producing the rings arrayed on the film carrier. The second etch typically takes 10 minutes at room temperature. However, the total etch time is less than 6 minutes at 60° C. Typical dimensions of the ring-shaped washers are about 220 mils of inner diameter and about 282 mils outer diameter yielding a washer width of approximately 30 mils.

Figure 5:
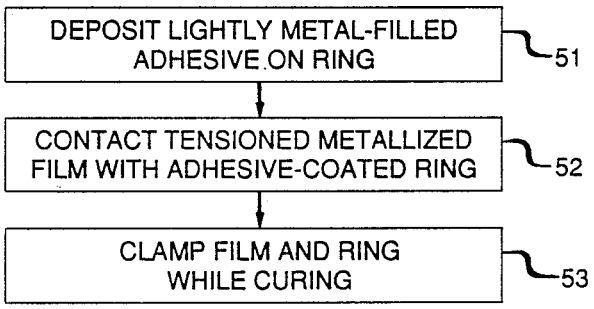
FIG. 5 is a block diagram of a method in accordance with an embodiment of the present invention.

Once the array of ring-shaped nickel-plated washers is formed, a predetermined quantity of lightly metal-filled adhesive is to be deposited on the rings as illustratively shown in block 51 of FIG. 5. In accordance with an embodiment of the invention, the lightly metal-filled adhesive is screen printed onto the array of rings. The screen print pattern to be used should provide enough adhesive for a fine bond line between the ring and the electret metallized film of less than 0.3 mil thick. Moreover, the adhesive screen printing step should insure complete annular coverage of the washer upon clamping without adhesive spillage into the central portion of the electret metallized film. A screen, e.g., a nylon mesh screen, with a print pattern therein of about 270 mils in outer diameter and about 240 mils in inner diameter enables the printing of an array of adhesive rings each having a width of about 15 mils and a height of approximately 1.1 mil.

Figure 4:
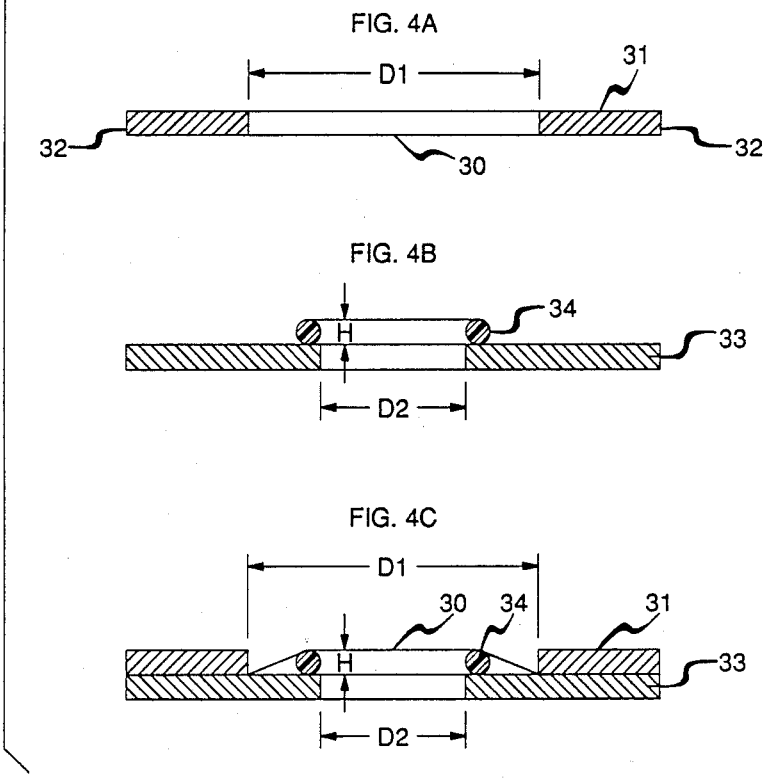
FIGS. 4*a* to 4*c* illustrate a technique for radially tensioning a sheet of electret material in accordance with the present invention.

As mentioned above, a predetermined radial tension in the electret diaphragm is required prior to adhesively bonding it to the metal ring. Shown in FIGS. **4*a* to 4*c* is an arrangement for radially tensioning a sheet of electret material 30 such as a 1 mil thick sheet of metallized FEP. A plate 31 having an opening of diameter D1 and a pressure sensitive adhesive around the periphery of the opening is used to hold the sheet of electret material 30 with its metallized surface in a face down position. A tension plate 33 having a smaller opening of diameter D2 than the opening of the plate 31 is used to provide a fixed tension to the electret sheet. The tension plate 33 supports a circular member 34 of predetermined height H around the periphery of the smaller opening. The member 34 may be of a commercially available type, such as an 0-ring. As shown in FIG. 4*c*, the plate 31 is brought in contact with the tension plate 33 with the electret film 30 sandwiched in between and uniformly radially tensioned due to the elevation H of the member 34. The sheet 30 may be, for example, a sheet of 8" by 8" cut from a roll of metallized electret material. The diameter D1 of the opening in plate 31 may be of the order of 6" and the diameter D2 of the opening in tension plate 33 may be of the order of 5". The plates/electret film assembly of FIG. 4*c*** provides the uniformly tensioned film for batch fabricating an array of electret diaphragms.

Subsequent to the tensioning of the electret sheet as shown in FIG. **4*c*, the carrier with the array of adhesive printed ring-shaped washers formed thereon is brought in contact with the pretensioned electret sheet as illustratively shown in block 52 of FIG. 5. The lightly metal-filled adhesive is tacky and will hold the washers in contact with the metallized electret sheet. In order to ensure a fine bond line completely covering the annulus of the washers and a good conductivity between the washers and the metal layer, the assembly is cured at a temperature ranging between 80° C.–120° C. under pressure as illustrated in block 53 of FIG. 5**. The foregoing temperature range for curing the assembly enables the simultaneous thermal stress stabilization of the electret material. After the cure of the adhesive, the carrier is peeled off the back of the washers thereby leaving the ring-shaped washers permanently bonded to the metallized surface of the electret sheet. The next step in the process is the separation of the individual electret diaphragms of the array formed by shearing the electret sheet clean around the outer edge of the washers.

The foregoing illustrative embodiments have been presented merely to illustrate the pertinent inventive concepts of the present invention. Numerous modifications, such as screen printing the adhesive on the metallized surface of the electret diaphragm instead of on the annular surface of the ring-shaped washers, or using other techniques to apply a lightly metal-filled adhesive between the washer and the electret diaphragm, can be made by those skilled in the art without departing from the spirit and scope of the invention.

What is claimed is:

1. An electret transducer comprising:

an electret diaphragm having a thin metal layer deposited on one of its major surfaces;

a ring-shaped metal washer made of nickel-plated brass material; and a layer of lightly filled metal-filled adhesive for bonding the electret diaphragm to the metal washer so that the electret diaphragm is uniformly radially tensioned thereby wherein the lightly filled adhesive comprises approximately 4% nickel.

* * * * *